US009056513B2

(12) United States Patent
Saito

(10) Patent No.: US 9,056,513 B2
(45) Date of Patent: Jun. 16, 2015

(54) INK RIBBON CARTRIDGE AND PRINTER

(75) Inventor: Shinya Saito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 184 days.

(21) Appl. No.: 13/300,400

(22) Filed: Nov. 18, 2011

(65) Prior Publication Data

US 2012/0128398 A1 May 24, 2012

(30) Foreign Application Priority Data

Nov. 19, 2010 (JP) ..... 2010-259102

(51) Int. Cl.
*B41J 31/14* (2006.01)
*B41J 32/02* (2006.01)
*B41J 31/16* (2006.01)

(52) U.S. Cl.
CPC . *B41J 32/02* (2013.01); *B41J 31/16* (2013.01)

(58) Field of Classification Search
CPC ..... B41J 31/00; B41J 31/14; B41J 35/30; B41J 32/02; B41J 31/16; B41J 32/00
USPC ..... 400/191–204.4
See application file for complete search history.

(56) References Cited

U.S. PATENT DOCUMENTS

| | | | | |
|---|---|---|---|---|
| 3,977,512 A | | 8/1976 | Teagarden et al. | |
| 4,213,715 A | | 7/1980 | Haftmann et al. | |
| 4,279,522 A | | 7/1981 | Yonkers | |
| 4,968,161 A | * | 11/1990 | Kunitomi et al. | 400/195 |
| 5,062,725 A | * | 11/1991 | Hogarth et al. | 400/195 |
| 5,230,575 A | * | 7/1993 | Kulesa et al. | 400/202.1 |
| 5,511,888 A | * | 4/1996 | Beach | 400/197 |
| 5,538,350 A | * | 7/1996 | Suzuki | 400/196 |
| 5,746,522 A | * | 5/1998 | Moreland | 400/197 |
| 5,902,057 A | * | 5/1999 | Furrow et al. | 400/196.1 |
| 6,017,158 A | * | 1/2000 | Conlan | 400/197 |
| 2002/0064409 A1 | * | 5/2002 | Gibson | 400/196 |

FOREIGN PATENT DOCUMENTS

| | | |
|---|---|---|
| EP | 0 017 961 A1 | 10/1980 |
| JP | 54-122911 | 8/1979 |
| JP | 59-102363 | 7/1984 |
| JP | 2-22858 | 2/1990 |
| JP | 07-132668 A | 5/1995 |

* cited by examiner

*Primary Examiner* — David Banh
(74) *Attorney, Agent, or Firm* — Rabin & Berdo, P.C.

(57) ABSTRACT

An ink ribbon cartridge holds an ink ribbon impregnated with ink. A casing includes two guide portions projecting from the casing. An ink ribbon formed in a Mobius loop, the ink ribbon including a width, the ink ribbon including a first half of the width and a second half of the width, the ink ribbon being housed in the casing and exiting the casing from a free end of one of the two guide portions and entering the casing from a free end of the other of the two guide portions. An ink supplying section supplies ink to the ink ribbon at an area in the first half of the width, the area being directly facing the casing between the two guide portions.

12 Claims, 16 Drawing Sheets

INK RIBBON CARTRIDGE AND PRINTER

BACKGROUND OF THE INVENTION

1. Field of the Invention

The present invention relates to an ink ribbon cartridge and a printer incorporating the ink ribbon cartridge.

2. Description of the Related Art

A conventional built-in ink ribbon cartridge for use in a printer includes a casing that accommodates an endless ink ribbon that forms a Mobius loop, and a cover that closes the casing to protect the ink ribbon from the environment.

The casing includes two projections such that the ink ribbon outside the casing is held taut between the two projects.

The casing accommodates a pull-in mechanism, an urging member, and a Mobius section. The pulling mechanism is disposed near a ribbon entrance, and pulls in the ink ribbon into the casing. The urging member applies a tension force to the ink ribbon when the ink ribbon is pulled out of a ribbon exit. The Mobius section provides in the ribbon an inversion or twist of 180° in a manner to form a Mobius loop.

Conventional built-in ink cartridges suffer from a problem in that if an ink supplying mechanism is built in, the ink is not used efficiently.

SUMMARY OF THE INVENTION

An object of the invention is to provide an ink ribbon cartridge in which ink is supplied only to a half of the width of the ink ribbon.

Another object of the invention is to provide an ink ribbon cartridge in which the ink is consumed efficiently without leaving some portion of ink unused.

Still another object of the invention is to provide a printer that operates at low running cost.

Yet another object of the invention is to provide a printer that incorporates the ink ribbon cartridge.

An ink ribbon cartridge holds an ink ribbon impregnated with ink. A casing includes two guide portions projecting from the casing. An ink ribbon is formed in a Mobius loop. The ink ribbon includes a width. The ink ribbon includes a first area of the width and a second area of the width, and is housed in the casing. The ink ribbon exits the casing from a free end of one of the two guide portions and enters the casing from a free end of the other of the two guide portions. An ink supplying section supplies ink to the ink ribbon at an area in the first area of the width.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
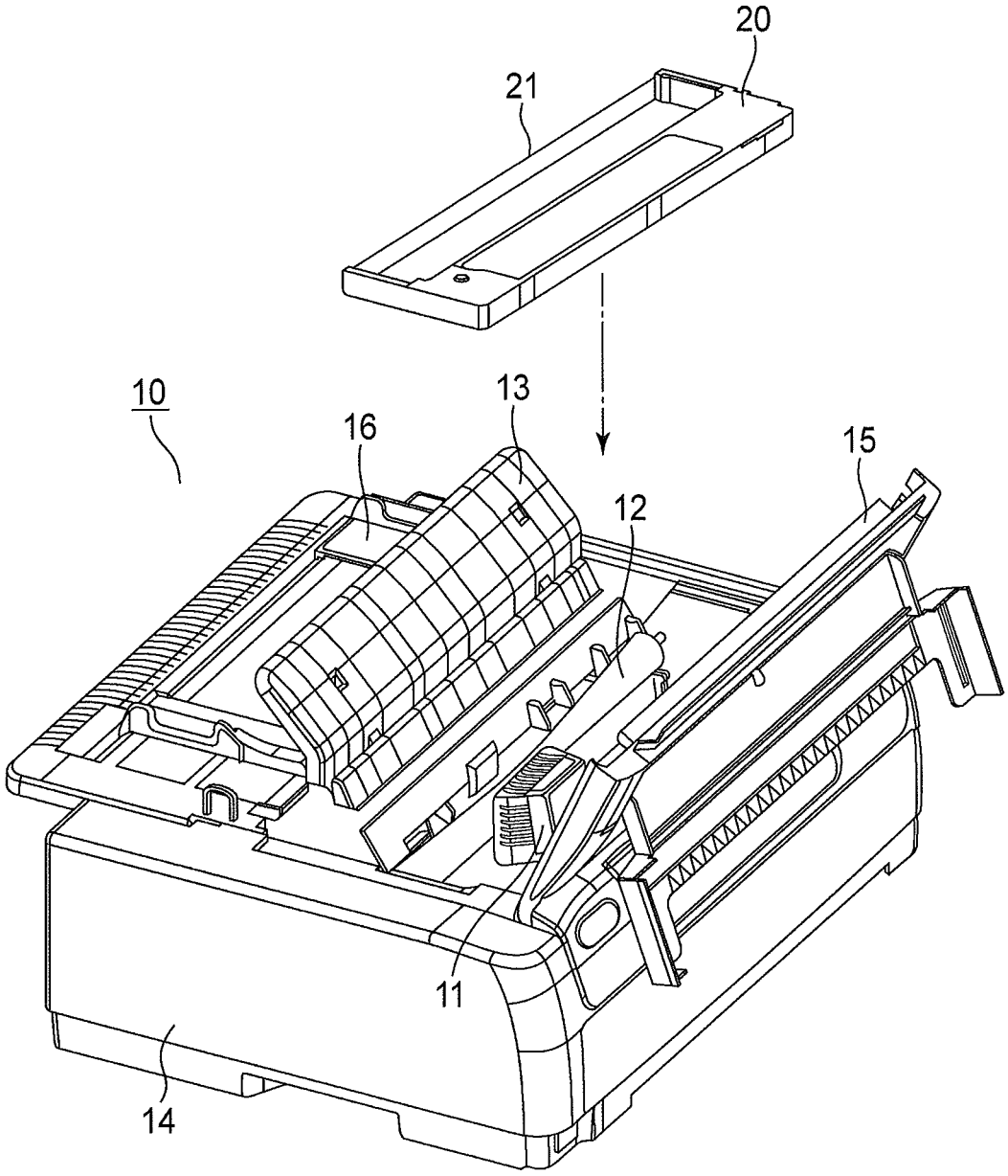
FIG. 1 is a perspective view illustrating a printer according to a first embodiment.

FIG. 1 is a perspective view illustrating a printer 10 according to a first embodiment.

The printer 10 takes the form of, for example, an impact dot printer, and receives print data from, for example, a host apparatus. The printer 10 prints the print data on a print medium (e.g., print paper) P by causing printing wires to strike an ink ribbon against a print medium P.

A carriage 11 is located to face a platen 12 and carries a print head 17 thereon. The print head 17 (not shown) includes a plurality of wires to strike the ink ribbon against the paper P to print characters, symbols, and graphics. The platen 12 rotates by a certain angle to advance the print paper P by a predetermined distance, every time the carriage completes a scanning cycle across the print paper P. The print paper P passes through the gap defined between the print head 17 and the platen 12, advancing in a direction substantially perpendicular to a direction in which the carriage 11 moves. A pull-up guide 13 serves to minimize page-to-page shift of the print paper if the print paper P is continuous copy paper.

The carriage 11 moves at predetermined pitches across the paper P in a direction in which the platen 12 extends longitudinally, as the print head 17 prints on the paper P. The ink ribbon cartridge 20 is installed into the printer from above.

Covers 14 (only one of which is shown) close side portions of the printer 10 to protect a variety of mechanisms (not shown) in the printer 10 from the environment. An access cover 15 protects the user from inadvertently touching the carriage 11 during printing. A rear sheet guide 16 feeds single sheets during printing in a manual feed mode.

Figure 2A:
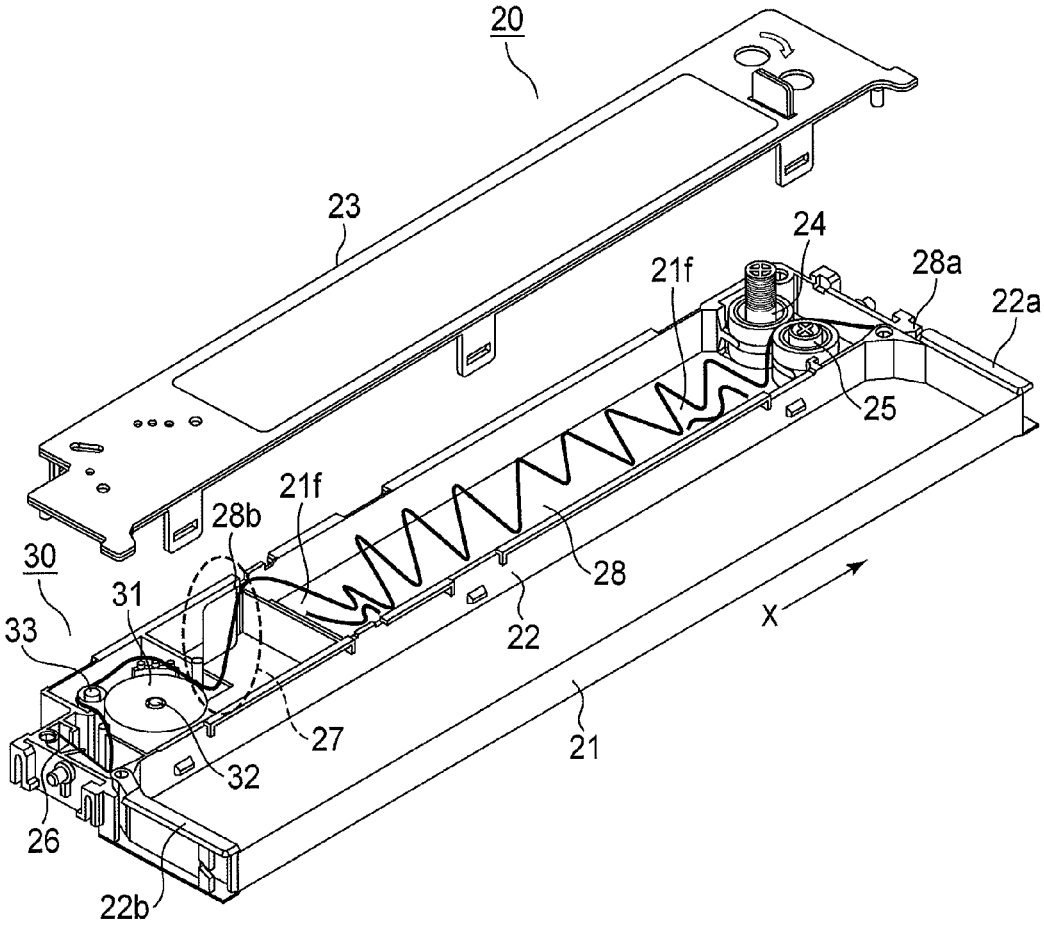
FIG. 2A is an exploded perspective view illustrating an ink ribbon cartridge shown in FIG. 1.
Figure 2B:
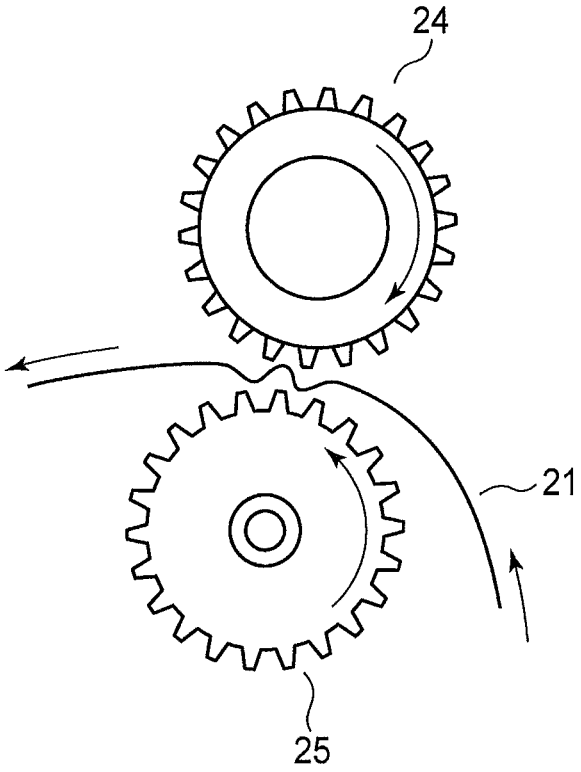
FIG. 2B is an enlarged view of a pull-in mechanism.

FIG. 2A is an exploded perspective view illustrating an ink ribbon cartridge 20 shown in FIG. 1. FIG. 2B is an enlarged view of a pull-in mechanism 29.

The ink ribbon cartridge 20 includes a casing 22 and a cover 23. The casing 22 includes an accommodating room 28 that accommodates a fan-folded portion 21*f* of the ink ribbon 21. The portion 21*f* is arranged in full fanfold fashion in such a manner that alternate loose folds or loops preferably extend substantially to the interior surface of each of the opposed inner wall of the casing 22. The cover 23 covers the ink ribbon 21, other mechanisms, and structures in the casing 22 to protect from the environment.

Guides 22*a* and 22*b* are substantially parallel to each other and laterally project from longitudinal end portions of the casing 212 in directions substantially perpendicular to a direction in which the casing 22 extends longitudinally. The ink ribbon 21 runs from the free end of the guide 22*b* to the free end of the guide 22*a*. Carrying the print head 17 thereon, the carriage 11 moves back and forth along the platen 12 during printing in an area defined by the casing 22, guides 22*a* and 22*b*, and the ink ribbon 21 running outside of the casing 22, The pull-in mechanism 29 for pulling in the ink ribbon 21 is located in the vicinity of a ribbon entrance 28*a* of the ink ribbon cartridge 20. The pull-in mechanism 29 includes a drive gear 24 and a driven gear 25. As shown in FIG. 2B, the drive gear 24 and driven gear 25 are in meshing engagement with each other with the ink ribbon 21 therebetween. When the drive gear 24 rotates, the drive gear 24 and driven gear 25 cooperate with each other to pull in the ink ribbon 21 through the ribbon entrance 28*a*.

An urging member 26 (e.g., tension spring) is located inside the casing 22 in the vicinity of the guide 22*b*, and urges the ink ribbon 21 against the casing 22, thereby applying some drag on the ink ribbon so that the ink ribbon 21 outside the casing 22 is in tension when the ink ribbon 21 is drawn out of the casing 22. An ink supplying section 30 is disposed immediately upstream of the urging member 26 with respect to the path in which the ink ribbon 21 advances. The Mobius section 27 is located immediately upstream of the ink supplying section 30, and causes the widthwise ends of the ink ribbon to invert vertically or twist by 180°.

The ink supplying section 30 includes an ink-impregnated body or ink roll 31, and ink roll wheel 32, and an ink transfer roller 33. The ink roll 31 is formed of felt material which is impregnated with the ink K, and freely rotates about the ink roll wheel 32 which is also freely rotatable. The ink roll 31 is in resilient contact with the ink transfer roller 33, so that the ink K is transferred from the ink transfer roller 33 onto an area 21*a* in the lower half (first area) of the width W of the ink ribbon 21 as the ink ribbon 21 advances in contact with the ink transfer roller 33.

Figure 3:
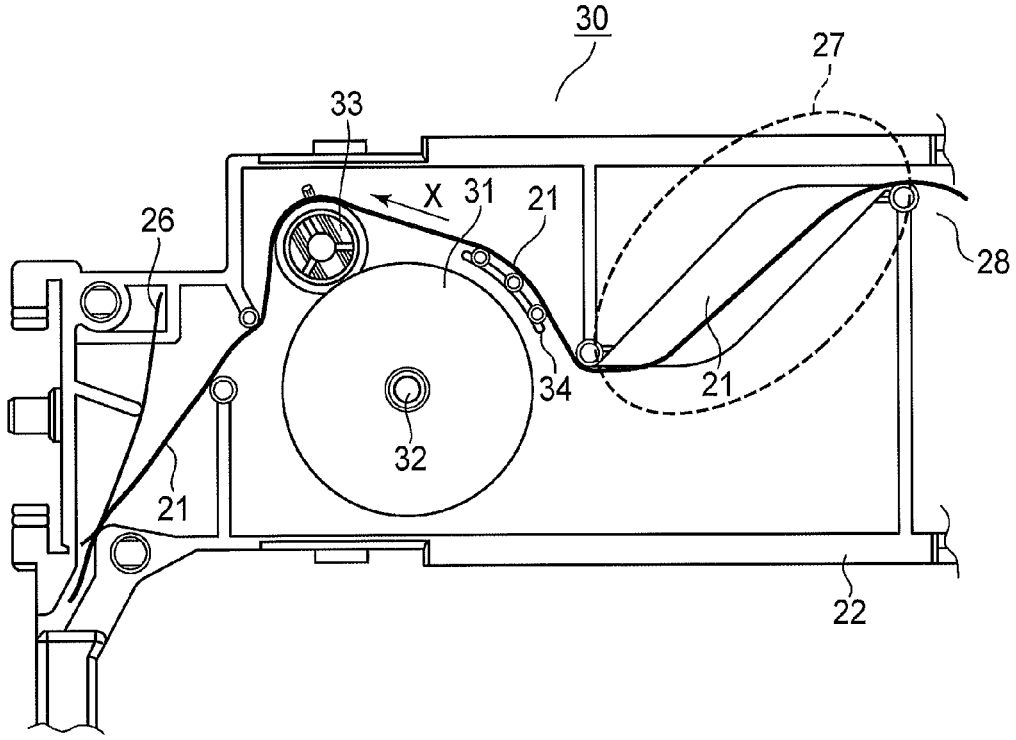
FIG. 3 is an enlarged view illustrating a vicinity of an ink supplying section shown in FIG. 2A.

FIG. 3 is an enlarged view illustrating a vicinity of the ink supplying section 30 shown in FIG. 1.

Figure 4:
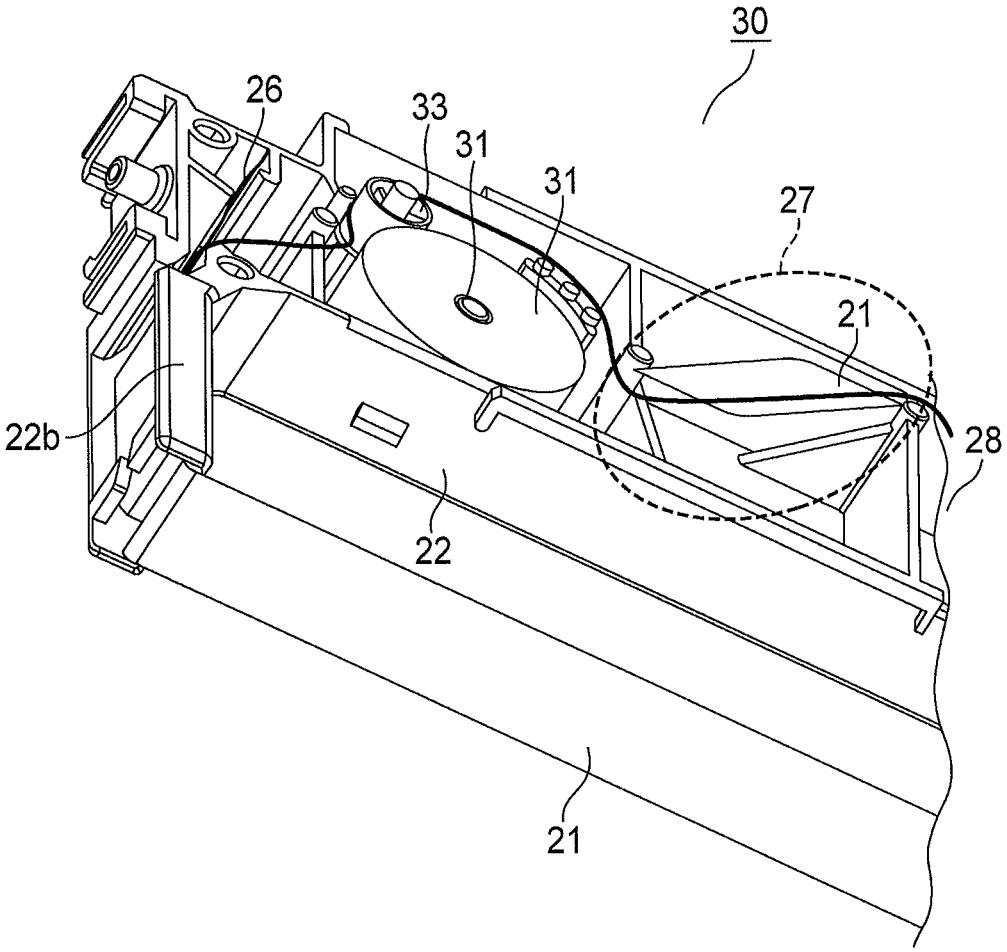
FIG. 4 is an enlarged perspective view illustrating a vicinity of the ink supplying section.

FIG. 4 is an enlarged perspective view illustrating the vicinity of the ink supplying section 30.

The Mobius section 27 is located immediately upstream of the ink supplying section 30 and downstream of the accommodating room 28, and causes the widthwise ends of the ink ribbon 21 to invert vertically or twist by 180° when the ink ribbon 21 is pulled in the direction of travel of the ink ribbon 21.

A ribbon guide 34 is located between the ink roll 31 and the Mobius section 27, and guides the ink ribbon 21 in a manner that the ink ribbon 21 does not contact the circumferential surface of the ink roll 31.

The ink ribbon 21 is pulled out of the accommodating room 28 and is then inverted by the Mobius section 27. The ink ribbon 21 moves into contact with the ink transfer roller 33 to receive the ink K. The ink ribbon 21 then exits the casing 22 through the guide 22*b* and advances from the guide 22*b* to the guide 22*a* in a direction shown by arrow X (FIG. 1), passing through a gap between the print head 17 and the print paper P.

Figure 5:
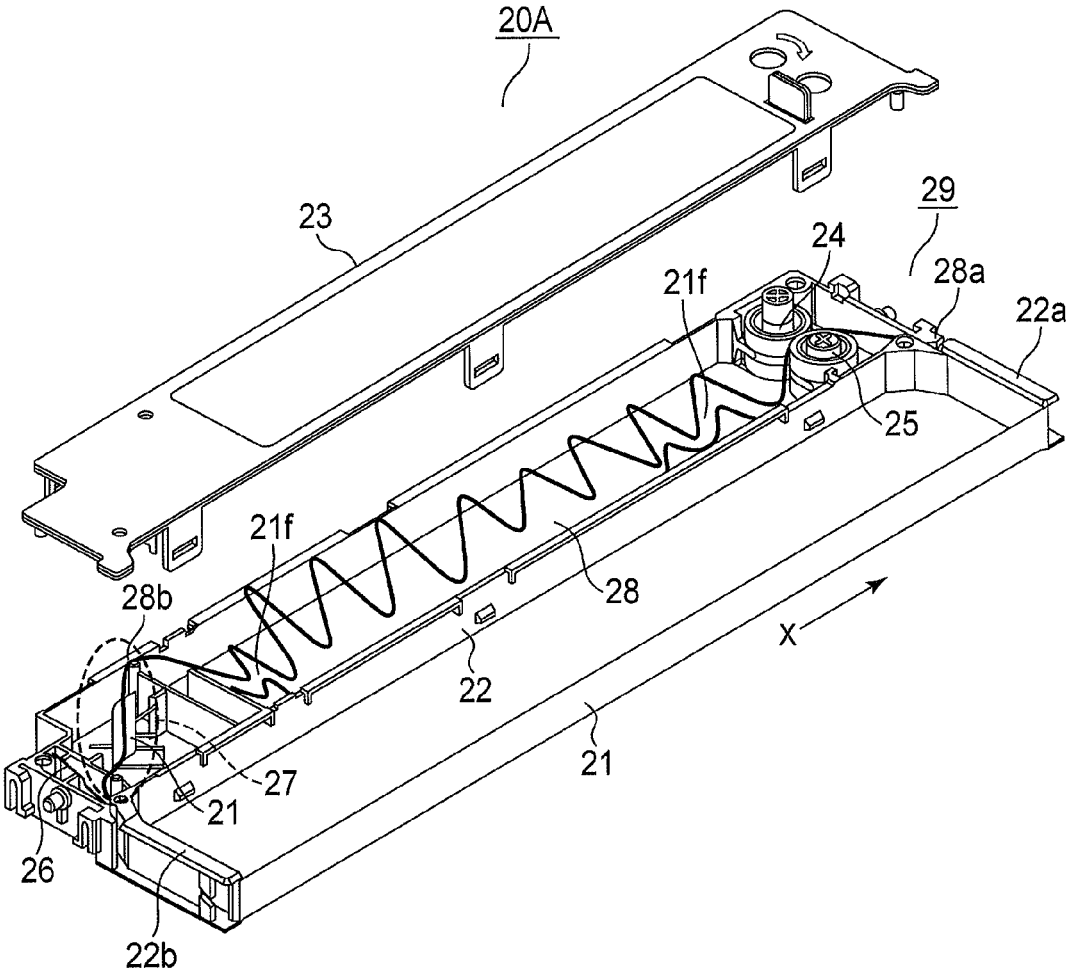
FIG. 5 is an enlarged perspective view of an ink ribbon cartridge as a comparative example.

FIG. 5 is an enlarged perspective view of an ink ribbon cartridge 20A as a comparative example.

The ink ribbon cartridge 20A has substantially the same configuration as the ink ribbon cartridge 20 and differs only in that the ink supplying section 30 is not employed.

Figure 6:
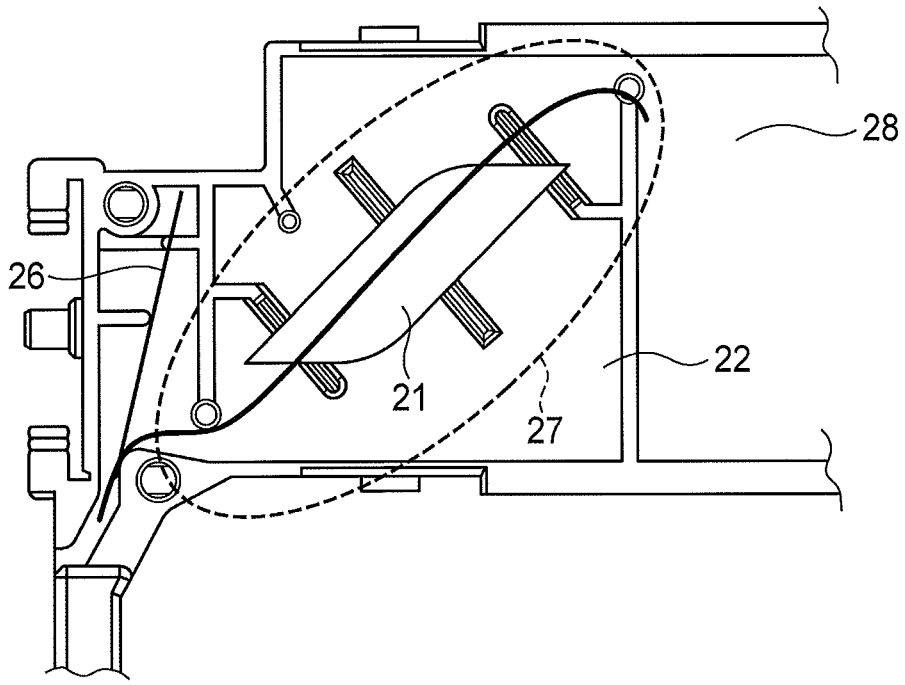
FIG. 6 is a partially enlarged view of a vicinity of the Mobius section shown in FIG. 5.
Figure 7:
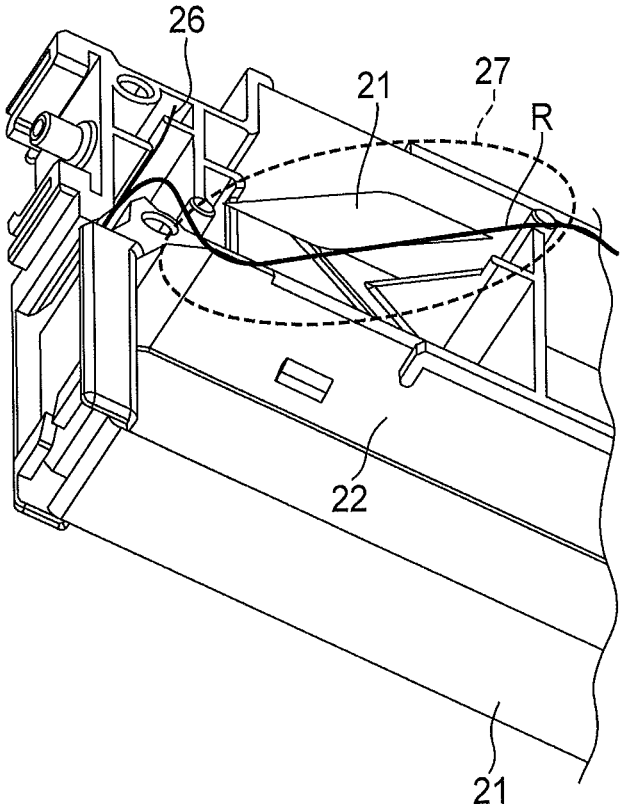
FIG. 7 is a partially enlarged view illustration a vicinity of the Mobius section.

FIG. 6 is a partially enlarged view of a vicinity of the Mobius section 27 shown in FIG. 5. FIG. 7 is a partially enlarged view illustration a vicinity of the Mobius section.

It is to be noted that the ink supplying section 30 (FIG. 4) is not located in the vicinity of the ribbon exit 28*b* of the accommodating room 28. The ink ribbon 21 exiting the accommodating room 28 is inverted or twisted by 180° by the Mobius section 27. Shortly after being inverted, the ink ribbon 21 exits the ink ribbon cartridge 20 through the guide 22*b*, and passes through a gap between the print head 17 and the print paper P.

Figure 8:
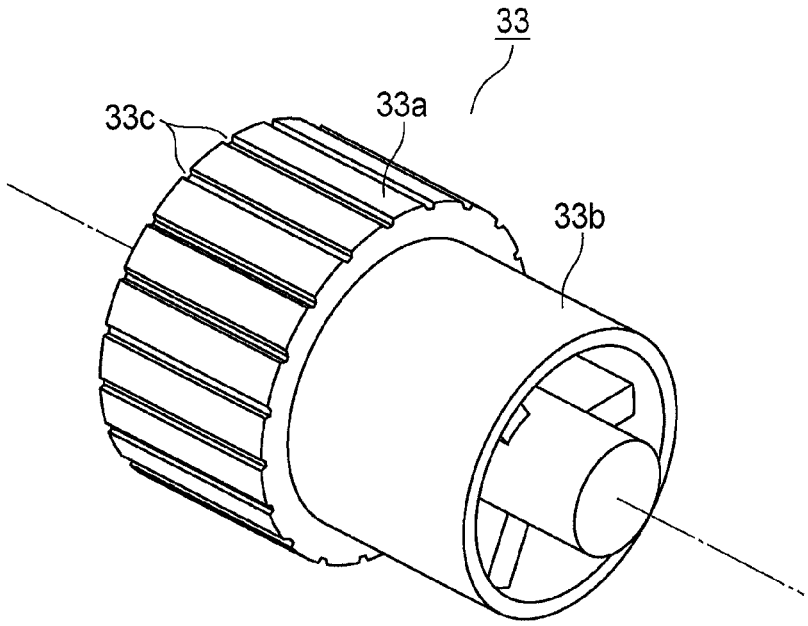
FIG. 8 is an enlarged perspective view of the ink transfer roller shown in FIG. 2.

FIG. 8 is an enlarged perspective view of the ink transfer roller 33 shown in FIG. 1. The ink transfer roller 33 is a rotatable body substantially in the shape of a cylinder. The ink transfer roller 33 rotates in contact with the ink roller 31 so that the ink K is supplied from the ink roll 31 to the ink transfer roller 33. The ink transfer roller 33 has a transfer section 33*a* and a non-transfer section 33*b*. The transfer section 33*a* contacts an area (e.g., 21*a*) in the lower half of the width W of the ink ribbon 21 and supplies the ink K to the ink ribbon 21. The non-transfer section 33*b* has a smaller diameter than the transfer section 33*a* and therefore does not contact the ink ribbon 21. The transfer section 33*a* has a circumferential surface with straight groves 33*c* formed therein, or a knurled surface. The straight grooves 33*c* effectively holds the ink therein. The ink ribbon cartridge 20 is installed into the printer 10 with the ink transfer roller 33 oriented such that the transfer section 33*a* is at a lower position and the non-transfer section 33*b* is at an upper position in a gravitational direction.

Figure 9:
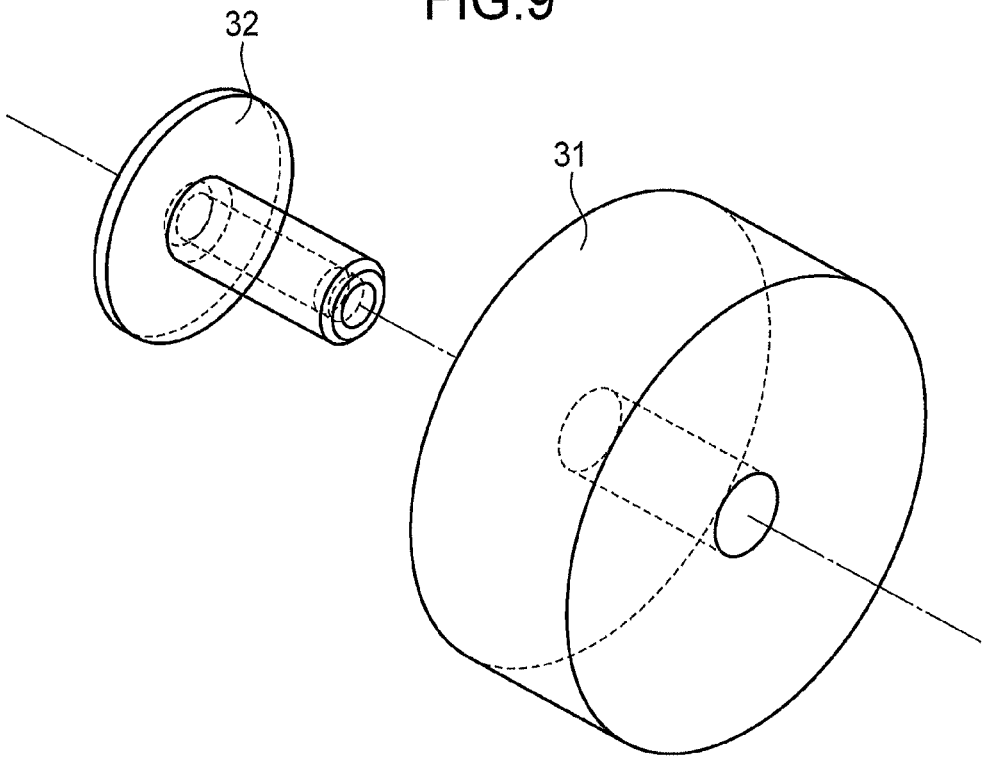
FIG. 9 is an enlarged perspective view illustrating the configuration of the ink roll and ink roll wheel shown in FIG. 2A.

FIG. 9 is an enlarged perspective view illustrating the configuration of the ink roll 31 and ink roll wheel 32 shown in FIG. 1.

The ink roll 31 is formed of a cylindrical felt material which is impregnated with the ink K. The ink K is supplied from the circumferential surface of the ink roll 31 to the ink transfer roller 33. The ink wheel 32 extends through the center of the ink roll 31 and drives the ink roll 31 to rotate. The ink roll 31 supplies the ink K little by little to the ink transfer roller 33. The ink in the ink roll 31 migrates from a portion near the rotational center of the ink roll 31 to the outer circumferential surface due to centrifugal force, so that the ink K inside the ink ribbon 31 can be thoroughly used without leaving a significant portion of ink unused. The ink roll 31 rotates at a speed of about 0.5 rps.

Figure 10:
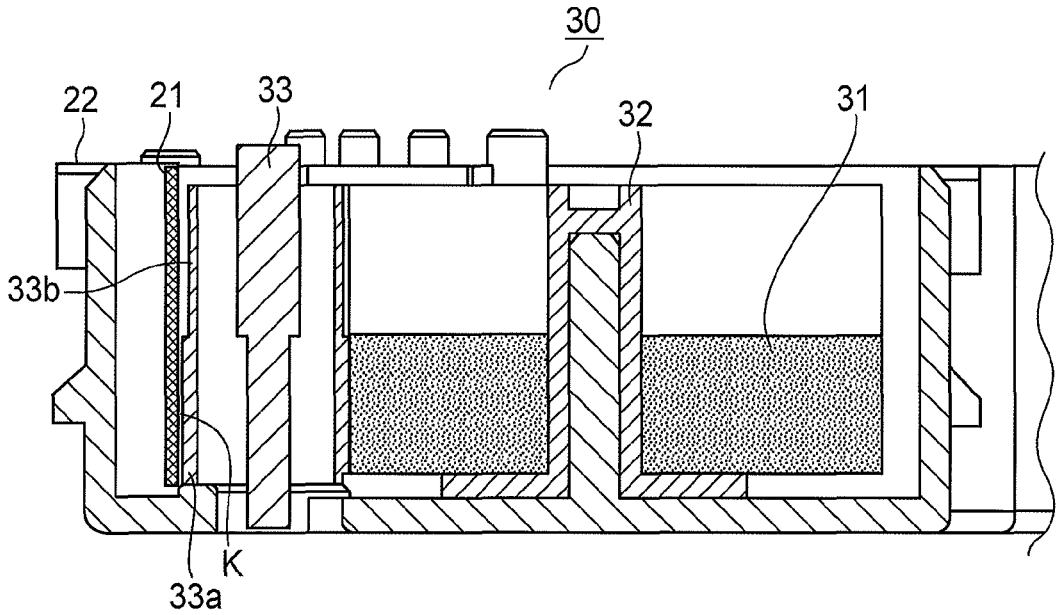
FIG. 10 is an enlarged cross-sectional view of the ink supplying section.

FIG. 10 is an enlarged cross-sectional view of the ink supplying section 30. The area in the lower half of the ink roll 31 holds the ink K therein. The print head 17 is configured to strike the area in the lower half of the width W of the ink ribbon to print on the print paper. For this reason, the upper half (second area) of the ink roll 31 is not in contact with the ink transfer roller 33, and only the lower half of the ink transfer roller 33 or the transfer section 33*a* is in contact with the lower half of the width W of the ink ribbon 21. Since the ink ribbon 21 makes a Mobius loop, the ink K is supplied to two halves of the width W of the ink ribbon 21 alternately upper half and lower half each time the ink ribbon 21 makes a complete revolution.

The running of the ink ribbon 21 causes the ink transfer roller 33 to rotate and the rotation of the ink transfer roller 33 causes the ink roll 31 to rotate.

Figure 11:
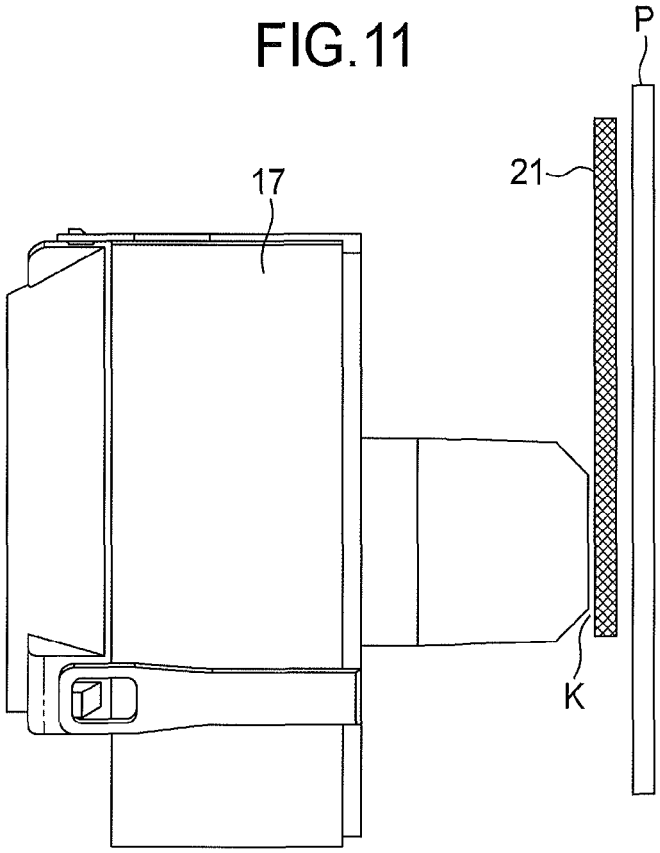
FIG. 11 illustrates the positional relation among the print head, ink ribbon, and print paper.

FIG. 11 illustrates the positional relation among the print head 17, ink ribbon 21, and print paper P. The print head 17 is carried on the carriage 11 (FIG. 2A) and runs across the print paper P at predetermined pitches in a direction parallel to the print paper, while the wires striking the ink ribbon 21 to print on the print paper P. It is to be noted that the wires strike an inner side of a loop of the ink ribbon 21 on which the ink K is supplied by the ink transfer roller 33. In this manner, the ink K in the ink ribbon 21 is transferred onto the print paper P, minimizing the chance of the ink in the ink ribbon of contaminating the print paper P.

Figure 12:
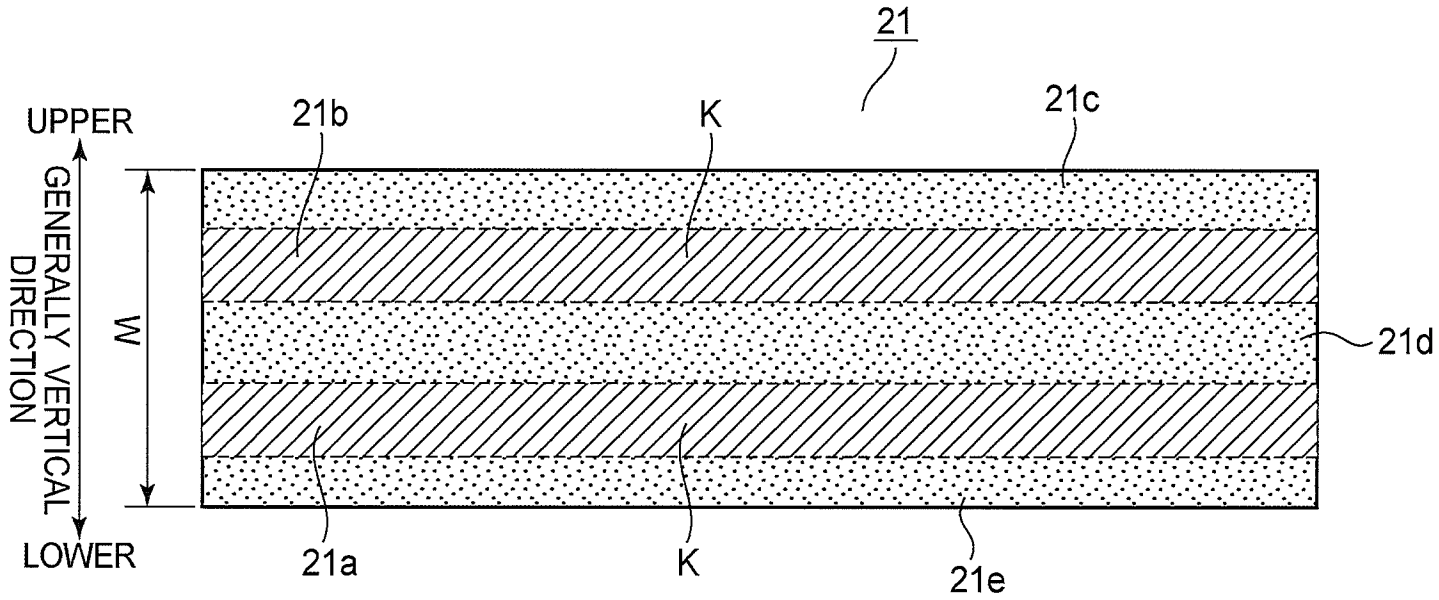
FIG. 12 illustrates areas of the ink ribbon that contribute to a printing operation.

FIG. 12 illustrates areas of the ink ribbon that contribute to the printing operation. A lower half of the width W of the ink ribbon 21 has an area (e.g., 21*a*) that directly faces the wires of the print head 17 during a preceding one of two consecutive revolutions of the ink ribbon 21. An upper half of the width W of the ink ribbon has an area (e.g., 21*b*) that directly faces the wires of the print head 17 during a following one of the two consecutive revolutions of the ink ribbon 21. Buffer areas 21*c*, 21*d*, and 21*e* are provided to isolate the areas 21*b* and 21*a*. The ink ribbon (21) is oriented such that the lower half (first area) of the ink ribbon 21 is lower than the longitudinal centerline of the ink ribbon 21 and the upper half (second area) of the ink ribbon 21 is upper than the longitudinal centerline. Thus, once the ink ribbon cartridge has been attached to the printer, the width of the ink ribbon 21 is oriented such that the lower half of the width W and the upper half of the width W are aligned generally vertical but may not be oriented exactly in a gravitational direction.

Operation of First Embodiment

Referring to FIG. 2A, the ink ribbon 21 is pulled in by the pull-in mechanism 29 through the entrance 28*a* of the accommodating room 28, the ink ribbon 21 running in the X direction. The pull-in mechanism 29 and the tension spring 26 cooperate to pull the ink ribbon 21 with tension therein.

Referring to FIGS. 3 and 12, the ink ribbon 21 is thus pulled by the pull-in mechanism 29, so that the ink ribbon 21 is inverted vertically or twisted by 180° by the Mobius loop section 27. After having passed through the Mobius loop, the ink ribbon 21 moves into contact with the ink transfer roller 33 so that the ink K is supplied to the lower half of the width W of the ink ribbon 21. The ink ribbon 21 then exits through the guide 22*b* and runs through the gap between the print head 17 and the print paper P.

Referring to FIG. 10, the lower half of the ink roll 31 holds most of the ink K therein and supplies the ink K to the ink transfer roller 33.

The ink transfer roller 33 is in contact with the ink ribbon 21. As the ink ribbon 21 runs, the ink transfer roller 33 is driven in rotation due to the friction between the ink ribbon 21 and the ink transfer roller 33.

Effects of First Embodiment

The ink ribbon cartridge 20 according to the first embodiment provides the following effects.

(1) The ink supplying section 30 supplies the ink K to the ink ribbon 21, thereby ensuring a prolonged printing operation of the ink ribbon cartridge 20 as opposed to an ink ribbon cartridge without the ink supplying section 30.

(2) The ink supplying section 30 is disposed as close a location to the ribbon exit 28*b* as possible, so that the fresh ink supplied to the ink ribbon 21 is promptly consumed in printing. This configuration provides vivid print results.

(3) The impregnated ink K tends to gather at a lower portion of the ink roll 31. Taking this tendency into account, the transfer section 33*a* is formed at the lower half of the ink transfer roller 33. Thus, the ink K may be used efficiently.

(4) The ink supplying section 30 is located downstream of the Mobius section 27 with respect to the direction of travel of the ink ribbon and upstream of the print head 17. This implies that the ink K is always supplied to the inside of the loop of the ink ribbon 21 between the Mobius section 27 and the print head 17. This configuration minimizes the chance of the ink ribbon 21 of contaminating the print paper P.

The printer 10 according to the present invention uses the ink ribbon cartridge 20. There is no need for replacing the ink ribbon cartridge 20 frequently since the ink ribbon cartridge 20 has a long life. In addition, the printer is capable of printing a vivid image since printing is performed shortly after the ink K is supplied to the ink ribbon 21.

Second Embodiment

Figure 13:
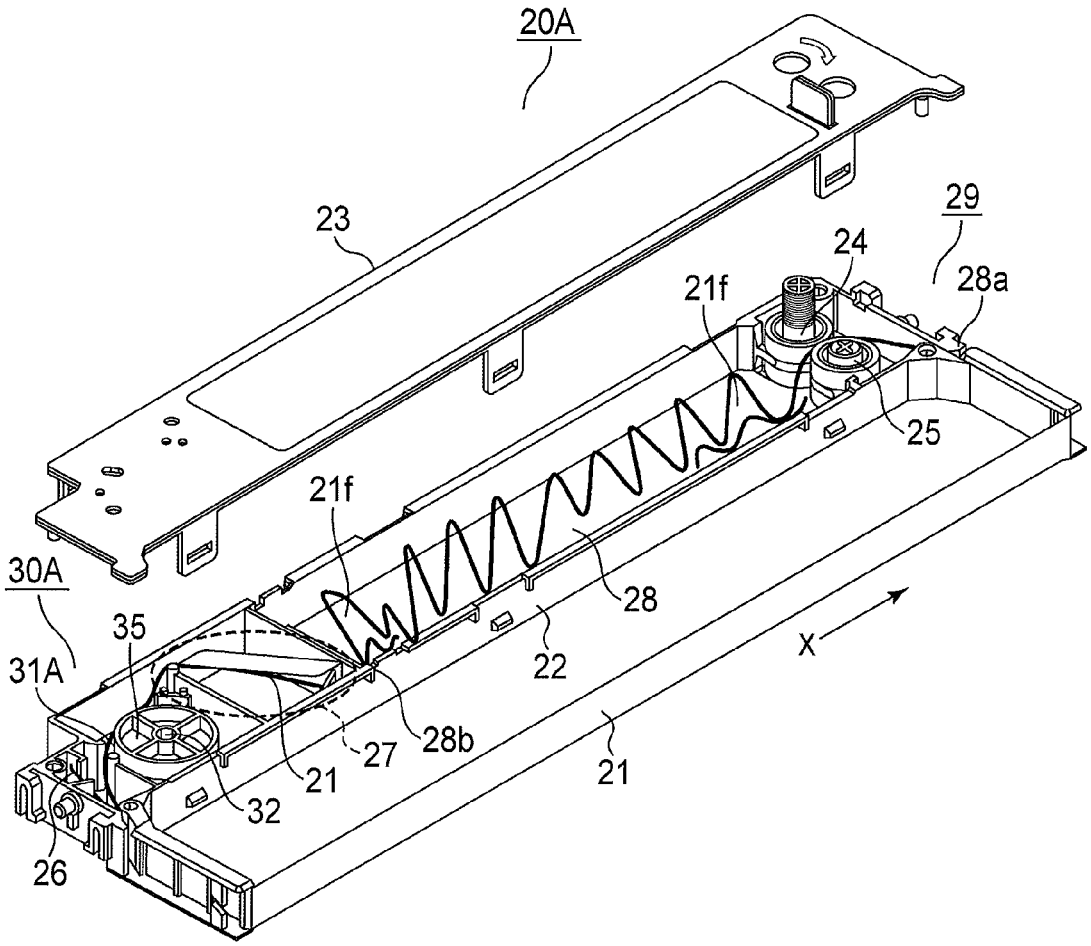
FIG. 13 is an enlarged perspective view of an ink ribbon cartridge according to a second embodiment.

FIG. 13 is an enlarged perspective view of an ink ribbon cartridge 20A according to a second embodiment.

The configuration of the ink ribbon cartridge 20A is substantially the same as that of the ink ribbon cartridge 20 of the first embodiment. The ink ribbon cartridge 20A differs from the ink ribbon cartridge 20 in that the ink transfer roller 33 is not used and an ink supplying section 30A is used. The ink ribbon cartridge 20A includes a casing 22 and a cover 23. The casing 22 includes an accommodating room 28 that accommodates a portion 21*f* of the ink ribbon 21 arranged in full fanfold fashion in such a manner that alternate loose folds or loops preferably extend substantially to the interior surface of each of the opposed inner wall of the casing 22. The cover 23 covers the ink ribbon 21, other mechanisms, and structures in the casing 22 to protect them from the environment. The casing 22 includes the accommodating room 28, guides 22*a* and 22*b*, a drive gear 24, an idle gear 25, a tension spring 26, a Mobius section 27, and the ink supplying section 30A.

Figure 14:
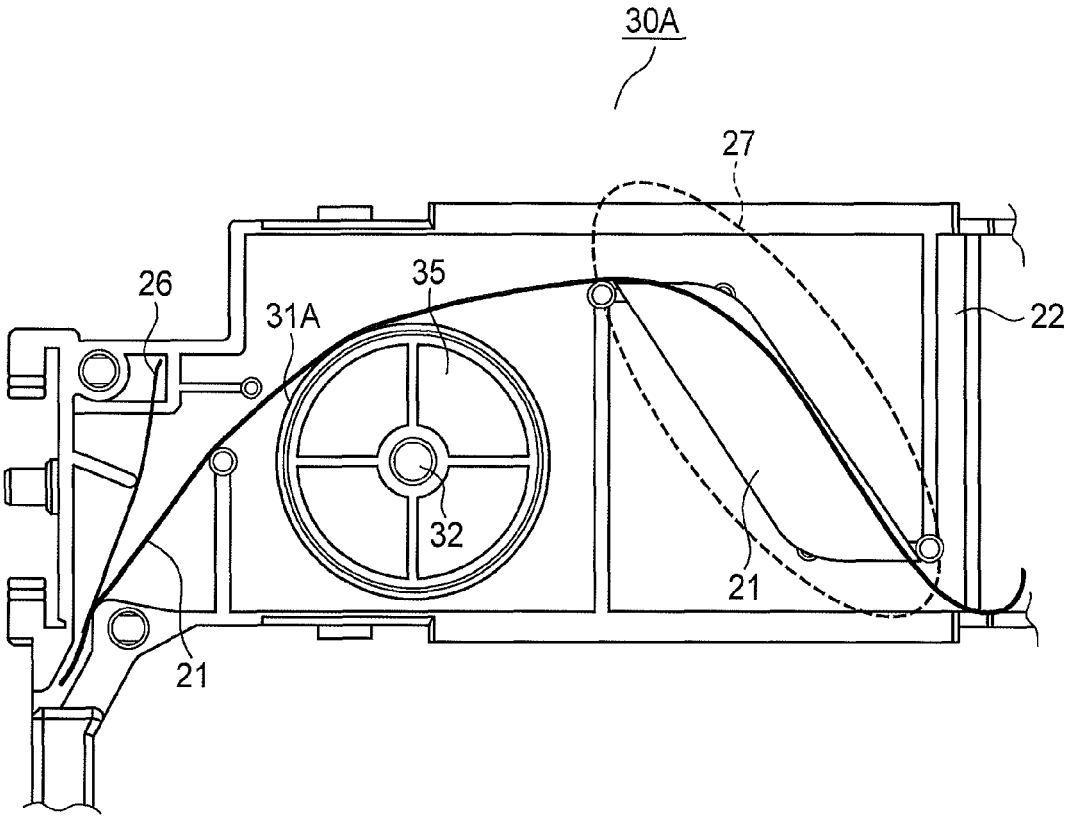
FIG. 14 is an enlarged top view of a vicinity of an ink supplying section shown in FIG. 13.
Figure 15:
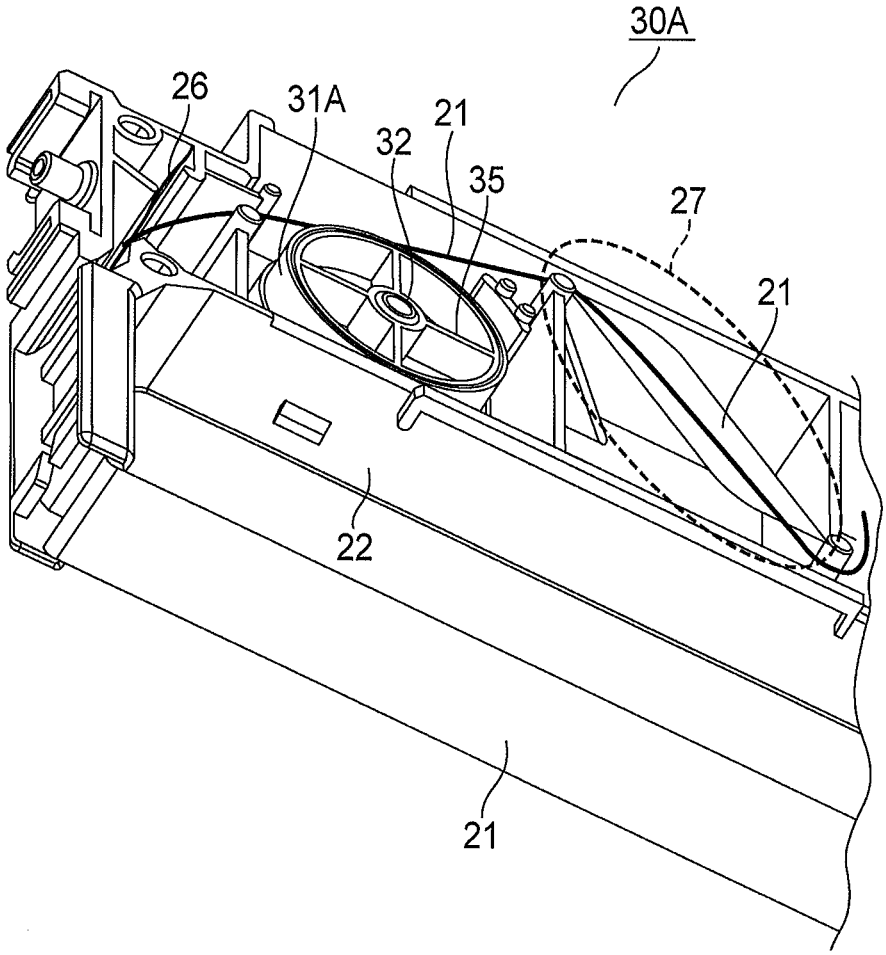
FIG. 15 is an enlarged perspective view of a vicinity of the ink supplying section.

FIG. 14 is an enlarged top view of a vicinity of the ink supplying section 30A shown in FIG. 13. FIG. 15 is an enlarged perspective view of a vicinity of the ink supplying section 30A.

The ink supplying section 30A includes an ink roll wheel 32, an ink roll 31A, and an ink roll stopper 35. The ink roll wheel 32 and ink roll stopper 35 cooperate to hold the ink roll 31A in position.

Figure 16:
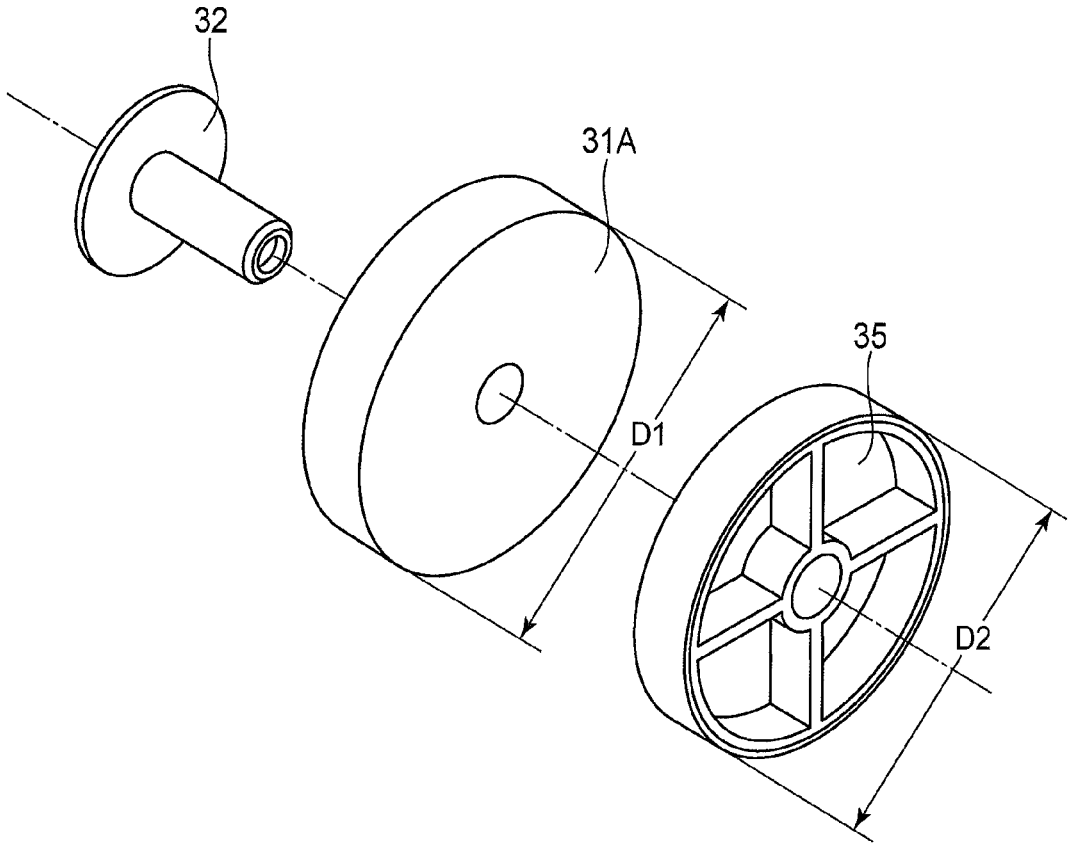
FIG. 16 is an exploded perspective view of the ink roll, ink roll wheel, and ink roll stopper shown in FIG. 13.

FIG. 16 is a perspective view of the ink roll 31A, ink roll wheel 32, and ink roll stopper 35 shown in FIG. 13.

The ink roll wheel 32 extends through the ink roll 31A and ink roll stopper 35 so that ink roll 31A, ink roll wheel 32, and ink roll stopper 35 are concentric. The ink roll 31A has an axial length approximately half of that of the ink roll 31 of the first embodiment. The ink roll 31A is driven in rotation by the ink ribbon 21 that advances in contact with the ink roll 31A. As the ink ribbon 21 advances, the ink roll 31A supplies ink K to the ink ribbon 21.

The ink roll stopper 35 has a diameter D2 which is smaller than that D1 of the ink roll 31A. The ink cartridge 20A is installed into a printer 10 (FIG. 2A) with the ink roll 31A positioned below the ink roll stopper 35, the ink roll 31A and the ink roll stopper 35 being aligned in a gravitational direction.

Figure 17:
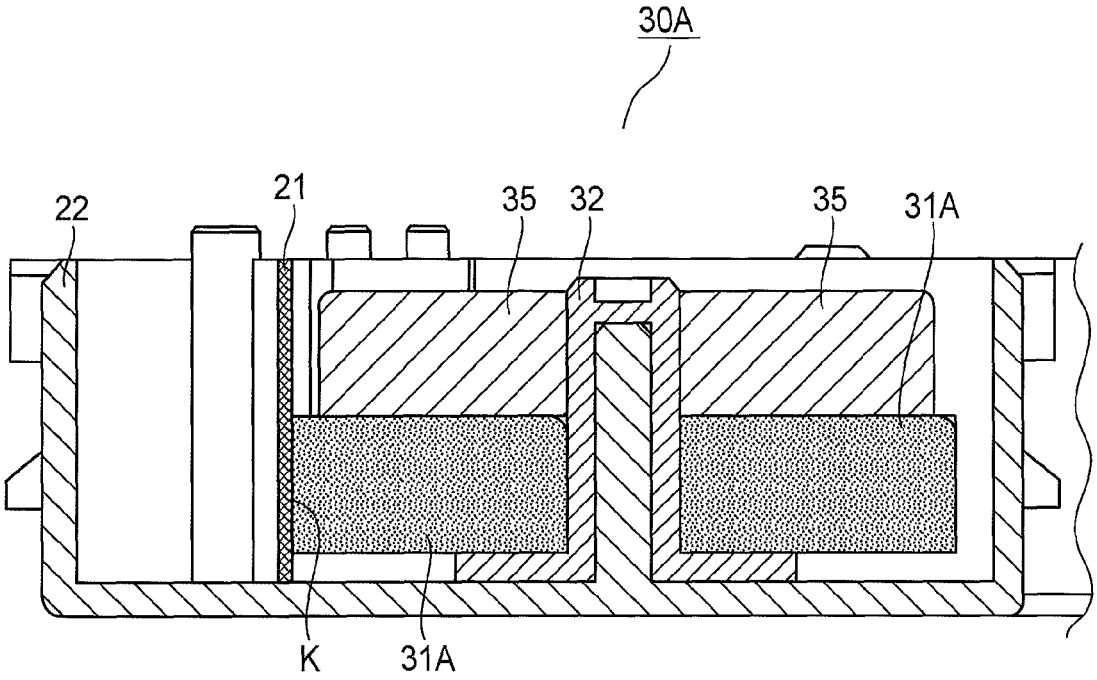
FIG. 17 is an enlarged cross-sectional view of the ink supplying section.

FIG. 17 is an enlarged cross-sectional view of the ink supplying section 30A. The ink roll 31 holds the ink K therein. The print head 17 is configured to strike the lower half of the width W of the ink ribbon 21 to print on the print paper P. The ink roll 31A is in contact with the lower half of the width W of the ink ribbon 21.

FIG. 13 illustrates the ink supplying section 30 located in the vicinity of an exit 28*b*. The ink roll 31A is journaled on the ink roll wheel 32 and is freely rotatable. The ink roll stopper 35 is over the ink roll 31A, and prevents the ink roll 31A from being pulled off the ink roll wheel 32. The ink roll 31A is impregnated with the ink K, and is in contact with the lower half of the width W of the ink ribbon 21. There is a small gap between the upper half of the width W of the ink ribbon 21 and the circumferential surface of the ink roll stopper 35.

As the ink ribbon 21 runs in contact with the ink roll 31A, the ink roll 31A is driven in rotation by means of friction between the lower half of the width W of the ink ribbon 21 and the ink roll 31A.

Operation of Second Embodiment

Referring to FIG. 13, the ink ribbon 21 is pulled in by the pull-in mechanism 29 through the entrance 28*a* of the accommodating room 28, the ink ribbon 21 running in the X direction. The pull-in mechanism 29 and the tension spring 26 cooperate to pull the ink ribbon 21 with tension therein.

Referring to FIGS. 13 and 14, the ink ribbon 21 is thus pulled in by the pull-in mechanism 29, so that the ink ribbon 21 is inverted vertically or twisted by 180° by the Mobius loop section 27. After having passed through the Mobius loop, the lower half of the width W of the ink ribbon 21 moves into contact with the ink roll 31A so that the ink K is supplied to the lower half of the width W of the ink ribbon 21. The ink ribbon 21 then exits the casing 22 through the guide 22*b*, and runs through the gap between the print head 17 and the print paper P.

Referring to FIG. 15, the lower half of the ink roll 31A holds most of the ink K therein and supplies the ink K to the ink ribbon 21. The ink roll 31 is in contact with the ink ribbon 21 and is driven in rotation as the ink ribbon 21 runs. The ink roll 31A supplies the ink K to an area of the ink ribbon 21 in contact with the ink roll 31A.

Effects of Second Embodiment

The ink ribbon cartridge 20A according to the second embodiment provides the following effects in addition to those of the first embodiment.

The second embodiment does not use the ink transfer roller 33. Thus, the second embodiment can be free from poor transfer of the ink K which would otherwise be caused by wear and/or improper rotation of the ink transfer roller 33.

The printer 10 according to the present invention uses the ink ribbon cartridge 20A. The printer 10 is capable of printing with good, reliable print results since the ink ribbon cartridge 20A is free from improper ink transfer operation.

Modification to First and Second Embodiments

A variety of modifications may be made to the first and second embodiments. Modifications may include the following.

(1) The first and second embodiments have been described in terms of a wire dot impact printer 10 which is an output apparatus for a computer. The printer 10 may be an automatic apparatus including an automatic teller machine (ATM) or a printer that is incorporated in a cash register and prints receipts.

(2) The printer 10 is not limited to the wire dot impact printer but may be type printers in which a print head has characters.

(3) The first and second embodiments may be modified in order to implement an ink ribbon cartridge that can be converted into an ink ribbon cartridge with an ink supplying section or an ink ribbon cartridge without an ink supplying section.

(4) The first and second embodiments may be modified to implement an ink ribbon cartridge in which a Mobius section is located in the vicinity of an entrance of a casing into which the ink ribbon enters.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A printer, comprising:

an ink ribbon cartridge; and a print head;

wherein the ink ribbon cartridge comprises:

an ink ribbon formed in a Mobius loop, the ink ribbon including a first area and a second area, the first area being a first half of the width of the ink ribbon, the second area being a second half of the width of the ink ribbon;

an accommodating room that accommodates a portion of the ink ribbon, the accommodating room including an entrance through which the ink ribbon is pulled in the accommodating room and an exit through which the ink ribbon is pulled out of the accommodating room;

a Mobius section that causes widthwise ends of the ink ribbon to twist by 180°, the Mobius section being located downstream of the accommodating room with respect to a direction of travel of the ink ribbon; and an ink supplying section that supplies ink to the ink ribbon, the ink supplying section being located downstream of the Mobius section with respect to the direction of travel of the ink ribbon;

wherein the ink ribbon includes an area in the first area, the area in the first area being struck by the print head downstream of the ink supplying section and upstream of the entrance with respect to the direction of travel of the ink ribbon; and wherein the ink supplying section supplies the ink to the ink ribbon at the area in the first area on a side of the ink ribbon, the side being struck by the print head at the area in the first area while directly facing the print head.

2. The printer according to claim 1, wherein the ink supplying section includes:

an ink holding member impregnated with the ink therein; and an ink transfer roller including a surface area in contact with a cylindrical surface of the ink holding member, the surface area also being in contact with the ink ribbon, wherein the ink transfer roller rotates while receiving the ink from the ink holding member and supplying the received ink to the ink ribbon.

3. The printer according to claim 2, wherein the ink ribbon is oriented such that the first area of the ink ribbon is lower than a longitudinal centerline of the ink ribbon and the second area of the ink ribbon is above the longitudinal centerline, wherein the ink holding member rotates in contact with the ink transfer roller and the surface area contacts the area in the first area of the ink ribbon so that the ink is supplied to the area in the first area of the ink ribbon.

4. The printer according to claim 1, wherein:

the ink ribbon is oriented such that the first area of the ink ribbon is lower than a longitudinal centerline of the ink ribbon and the second area of the ink ribbon is above the longitudinal centerline; and the ink supplying section includes an ink holding member impregnated with the ink therein, the ink holding member being in contact with the area in the first area of the ink ribbon to supply the ink to the area in the first area of the ink ribbon.

5. The printer according to claim 3, wherein:

the ink holding member is a cylinder of felt material; and the ink supplying section includes a supporting member by which the ink holding member is rotatably supported.

6. The printer according to claim 1, wherein the ink supplying section includes:

a transfer section that faces the first area of the ink ribbon and supplies the ink to the first area; and a non-transfer section that faces the second area of the ink ribbon and does not supply the ink to the second area.

7. The printer according to claim 6, wherein:

the ink supplying section includes a cylindrical body including the transfer section and the non-transfer section; and the non-transfer section has a smaller diameter than the transfer section.

8. The printer according to claim 6, further comprising a ribbon guide located upstream of the ink supplying section and downstream of the Mobius section;

wherein the ink supplying section includes an ink holding member, and the ribbon guide guides the ink ribbon such that the ink ribbon is away from the ink holding member.

9. The printer according to claim 1, wherein the print head includes striking members that strike the ink ribbon to transfer the ink in the ink ribbon onto the print medium.

10. The printer according to claim 9, wherein the striking members are wires that strike the first area during a printing operation.

11. The printer according to claim 2, wherein:

the ink holding member is a cylinder of felt material; and the ink supplying section includes a supporting member by which the ink holding member is rotatably supported.

12. A printer, comprising:

an ink ribbon cartridge; and a print head;

wherein the ink ribbon cartridge comprises:

an ink ribbon formed in a loop;

an accommodating room that accommodates a portion of the ink ribbon, the accommodating room including an entrance through which the ink ribbon is pulled in the accommodating room and an exit through which the ink ribbon is pulled out of the accommodating room; and an ink supplying section that supplies ink to the ink ribbon, the ink supplying section being located downstream of the accommodating room with respect to a direction of travel of the ink ribbon;

wherein the ink ribbon includes an area, the area being struck by the print head downstream of the ink supplying section and upstream of the entrance with respect to the direction of travel of the ink ribbon; and wherein the ink supplying section supplies the ink to the ink ribbon at the area that is disposed on a side of the ink ribbon, the side being struck by the print head at the area while directly facing the print head.

* * * * *